United States Patent [19]

Kimber

[11] Patent Number: 4,917,216

[45] Date of Patent: Apr. 17, 1990

[54] SEGMENTED LADDER CONSTRUCTION

[76] Inventor: Edward G. Kimber, 5255 Lakeshore Blvd., Burlington, Ontario, Canada, L7L X8

[21] Appl. No.: 364,966

[22] Filed: Jun. 12, 1989

[30] Foreign Application Priority Data

Jun. 16, 1988 [CA] Canada ..... 569687

[51] Int. Cl.[4] ..... E06C 1/10

[52] U.S. Cl. ..... 182/151; 182/178; 182/219; 182/228

[58] Field of Search ..... 182/151, 178, 194, 228, 182/219

[56] References Cited

U.S. PATENT DOCUMENTS

| | | | |
|---|---|---|---|
| 1,363,418 | 12/1920 | Jacobs | 182/194 |
| 1,422,654 | 11/1922 | Bilger et al. | 182/178 |
| 2,900,041 | 8/1959 | Leavitt et al. | 182/178 |
| 2,993,561 | 7/1961 | Watson | 182/195 |
| 3,871,481 | 3/1975 | Ballek | 182/151 |
| 3,997,027 | 12/1976 | Patterson | 182/178 |
| 4,060,150 | 11/1977 | Hughes | 182/178 |
| 4,086,980 | 5/1978 | Shortes | 182/178 |
| 4,215,766 | 8/1980 | Littlefield | 182/178 |
| 4,228,872 | 10/1980 | Treitz | 182/194 |

*Primary Examiner*—Reinaldo P. Machado

[57] ABSTRACT

A construction unit for assembling into a ladder like assembly wherein the unit is provided with parallel and opposed side rails joined by at least one cross-member, the ends of the side rails being adapted for end to end telescopic joining into a multi-unit assembly, the side rails of the units being hollowed to accept, internally thereof, elongated reenforcing and retaining members which may be threaded through all the side rails, in sequence, of an assembly of units.

9 Claims, 2 Drawing Sheets

SEGMENTED LADDER CONSTRUCTION

FIELD OF THE INVENTION

This invention relates to ladder and similar constructions and more particularly to segmented ladder or like constructions and improvements thereon.

DESCRIPTION OF PRIOR ART

Segmented constructions of the type we are herewith concerned are known, for instance, that described and claimed in U.S. Pat. No. 3,5499,0200—Van Bohr et al—issued Dec. 22, 1970.

According to this patent modular shelving units, which individually serve as single-step ladder units, are provided with telescoping joints so that the units can be mounted in tandem and form an elongated ladder construction as shown in FIG. 1 of the patent. These units are designed for use in the upright position only, as stated, and represent an unsafe construction for use as an inclined ladder. The shelve or step part of the construction is a separate unit. This construction is assembled from separate side rails and shelving and as such will only be securely rigid when used as a vertical shelving unit.

U.S. Pat. Nos. 2,993,561 - Watson - issued July 25, 1961 shows a collapsible ladder comprising individual and serially telescoping side rail elements with insertable steps which have the function, in addition, of preventing longitudinal ladder collapse or telescoping. The construction, in order to be secure, must be made of inherently strong material. In addition the plurality of different sized side rails, facilitating the telescoping action, and the separate step or rung members makes the assembly, as a whole, complex and expensive. Furthermore, a base member 9 is required to mount the ladder on and ensure proper alignment of the side rails. A somewhat similar construction, not completely telescoping, is shown in United States patent - Shortes et al issued May 2,1978.

A further U.S. Pat. No. 2,900,041 - Leavitt et al issued Aug. 18, 1959 shows a sectional ladder of multi-step units which may be assembled by means of the telescoping joints provided between sections.

The constructions referred to above are assembled from multiple parts requiring considerable labor and related costs in manufacture. The constructions must be inherently strong enough to perform the desired function and hence cannot be the most economical to manufacture.

OBJECTS OF THE INVENTION

It is an object of the present invention to provide individual step ladder units, or like devices, which are economical to manufacture, of light weight but still having sufficient strength, when assembled into ladder units or similar constructions, for the use proposed.

It is a further object of the invention to provide individual step ladder units which are of uniform or common form, easily assembled into multi-unit ladder or similar constructions and readily boxed for easy handling and shipping.

It is a still further object of the invention to facilitate the incorporation of strengthening elements in the side rails of multiunit constructions to provide the strength required for the use to which the construction is to be subjected.

It is another object of the invention to provide a ladder or like construction which is easily repairable, and strong and resilient with respect to damage caused by rough usage.

BRIEF DESCRIPTION OF THE INVENTION

In accordance with the present invention single-step ladder units, or similar constructions, are provided with tubular or channeled side rail members, two of which are integrally joined by a reenforcing single cross step in an H-like configuration. Each side rail, at one end, is of reduced size so that these reduced ends will telescopically insert into the unreduced end sections of an adjoining ladder unit. The channeled or tubular side rails are adapted to accept therein reenforcing members which provide the required bending resistant strength and, at the same time, act as a means to secure the units in multi-step ladder configuration or similar constructions.

The unit is preferably made of thin sheet material such as Borg Warner's high impact A.B.S. plastic in a blow molding process. This type of plastic material will protect the reenforcing members, to a great extent, from damage during use, especially if the sheet material does not fit too closely on the reenforcing members.

DETAILED DESCRIPTION OF THE INVENTION

Figure 2:
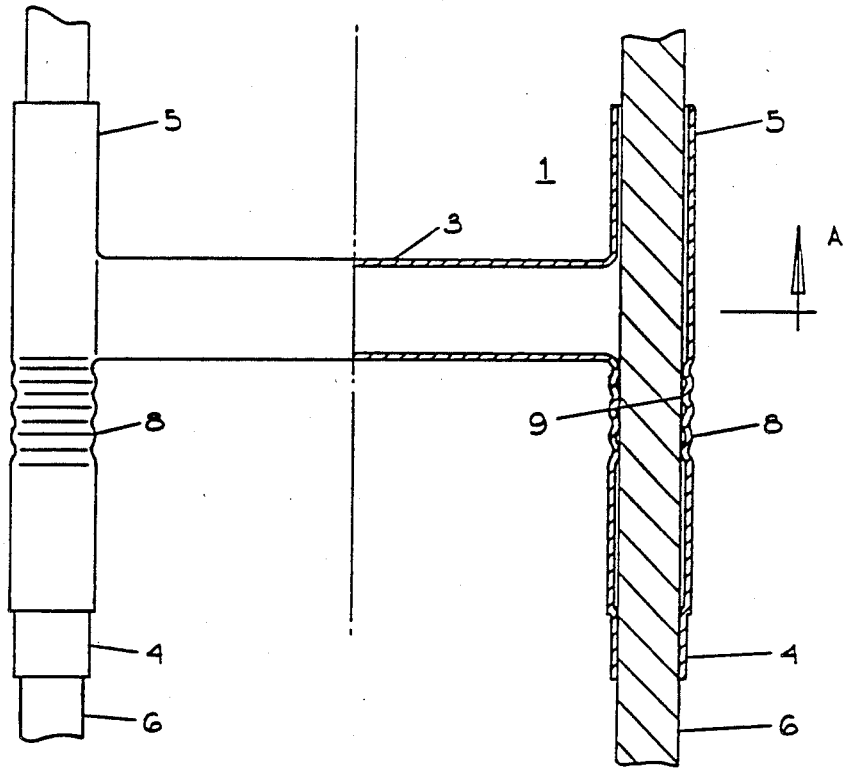
FIG. 2 shows an individual -step unit, according to the invention, wherein the unit side rails are contoured to facilitate hand-gripping and temperature compensation resilience.

Referring now to the figures of the drawings the individual step units 1 are in the configuration of an H, as best shown in FIG. 2. The side rails 2 of the units are in the form of rectangular cross-section tubes which are joined together by an integral step 3 to form an integral side-rail single-step unit. In order to ensure uniformity in manufacture and resultant ease of assembly and, as well, economy in manufacture, it is proposed to form the units by a plastic blow-molding process. In such a process the necessary reenforcing for the step part may be incorporated in the form of webs or flanges, not shown herein, in order to maintain simplicity in this description.

Each individual step unit is shown as being provided with reduced end sections 4 which will telescopically insert into the unreduced end section 5 of a further unit to be assembled therewith.

Figure 1:
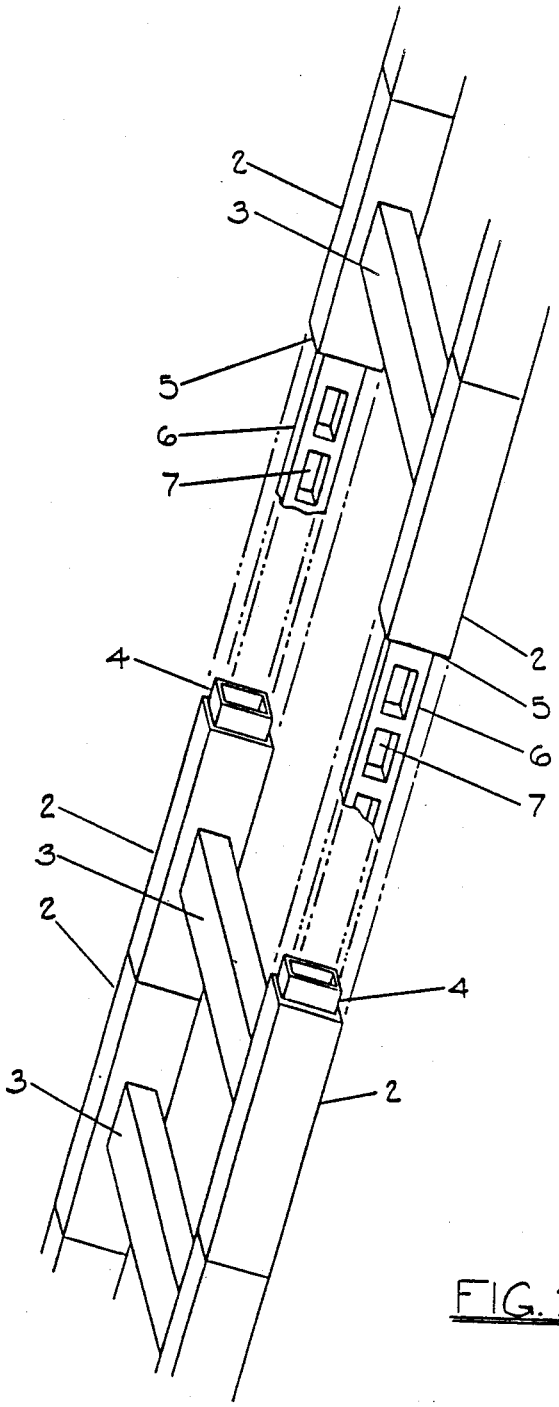
FIG. 1 shows the basic construction of a ladder, according to the invention, in partially assembled view.

Reenforcing members 6 are insertable into the side rail members of assembled units to provide the bending resistance strength required for the assembly thus making it possible to reduce the quantity of material used in the single-step unit side rails 2, leading to economy of manufacture and lighter weight. The reenforcing rails may be made of metal, for instance aluminum tubing, wood, fibre glass or other suitable material. However wooden members, i.e. pressure treated, are preferred since they are light and have been found to provide sufficient strength for most uses. Furthermore, in order to ensure lightness and consequent ease of handling of an assembled unit the reenforcing members may be provided with cut-outs 7, see FIG. 1, while still maintaining adequate strength as will be obvious to those knowledgeable in the fields concerned with bending and twisting stresses. It is not necessary that the reenforcing members firmly contact the inner surfaces of the side rails and may only contact them at their reduced cross-section ends and possibly adjacent the step area thus providing less frictional resistance during assembling. A particular advantage of a less than firm fit is that small impact denting or bending of the side rails will result in little or no damage to the reenforcing members 6. The use of high impact plastic will tend to maintain the appearance of the assembled units during rough usage.

Figure 3:
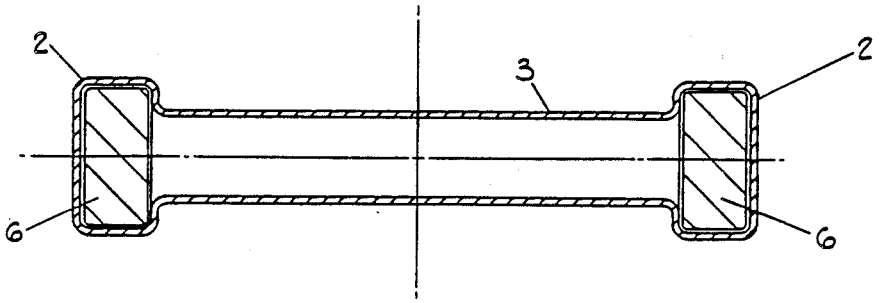
FIG. 3 shows an end view, partially in cross-section, of the unit shown in FIG. 2.

If desired, the side rails of the H units may be provided with hand grip corrugations 8 which facilitate handling and which may, as shown at 9 in FIG. 3, provide the contact area between the side rails and the reenforcing members adjacent the step location of the H units. In addition the corrugations will act as expansion joints to compensate for expansion and contraction due to temperature changes.

Figure 4:
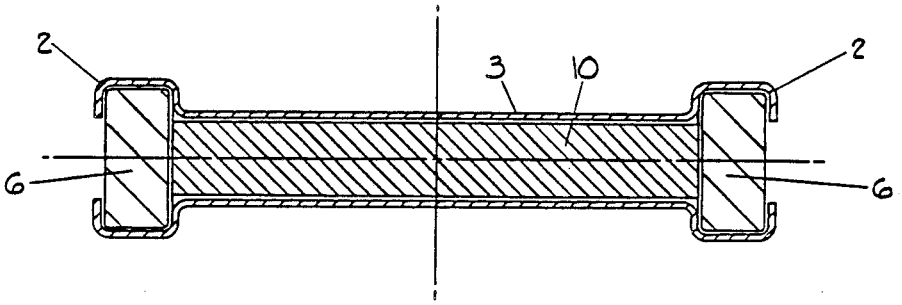
FIG. 4 shows an end view, a modification of the construction as shown in FIG. 3, wherein the side rails are of open channels.

Although tubular side rails 2 are shown it will be apparent that open channel constructions, for these side rails, (see FIG. 4) may be used when care is taken to ensure the cooperation between the assembled H units and the reenforcing members is such as to provide the strength required in the assembled units. Furthermore step stiffening members 10 may be employed, with the open channel construction, to provide greater step strength. The step stiffeners are inserted through the channel openings and retained in the steps by the reenforcing members 6.

The preferred method of assembly of a ladder unit or similar construction is to insert the reenforcing members 6 in a starter or first single-step unit 2 and then slip the remaining required single step units over the reenforcing members into sequentially telescoping joints with assembled units until the required total length of the construction is obtained. Thereafter any excess length of side rails can be removed.

When the required ladder length is obtained the assembly can be secured as a composite unit by fastening, at least, the end H units to the reenforcing members by, for instance, wood screws or bolts.

It will now be apparent that the invention provides an unique, economical and simple method of achieving ladder or similar constructions which may be simply packed and shipped, in unassembled form, for assembly at a remote location. The ladders, furthermore, may be readily lengthened or shortened as desired with minimum difficulty and cost. In addition, if a unit of the assembly is damaged it may be readily replaced.

It should be noted that the embodiment of the invention, set forth in the foregoing description and shown in the drawings, is provided as an example only and that changes to and modifications thereof can be made without departing from the spirit and scope of the invention as set forth in the appended claims.

I claim:

1. A construction unit for assembling into a multi-step ladder similar device comprising, a unit provided with two spaced and parallel opposed side rails, a cross member joined at each of its ends to one of the side rails to form a unit having a H like configuration, at least one end of each side rail being reduced to facilitate telescopic insertion into the unreduced end of a further H like unit to form a stepped ladder like construction, and wherein the side rails are adapted to, at least partially, enclose and retain elongated reenforcing members which are inserted into the side rails to reenforce the side rails and act as retainers for securing units in assembled relationship.

2. A construction unit as claimed in claim 1, wherein the H like unit is manufactured as an integral unit by means of a blow molding process.

3. A construction unit as claimed in claim 1 or 2, wherein the side rails are tubular.

4. A construction unit as claimed in claim 1 or 2, wherein the side rails are of channel cross-section adapted to accept and retain the reenforcing members, the open side of the channels being directly opposed with respect to the location of the cross member.

5. A construction unit as claimed in claim 1, wherein the reenforcing members are provided with a plurality of centrally located cut-outs which reduce the weight thereof while retaining sufficient reenforcing strength.

6. A construction unit for assembling into a multi-step ladder or similar device comprising, a unit provided with spaced, parallelopposed side rails, at least one cross member joined to each side rail to form a step of a ladder unit, at least one end of each side rail being reduced in cross-section in order to telescopically insert into an unreduced end of a side rail of a like unit to form a multi-stepped ladder-like construction, and wherein the side rails are adapted to, at least, partially enclose and retain elongated members which may be inserted into the side rails and act as a retainers for securing the units in an assembled relationship and, further, act as reenforcing members for the side rails of the assembly.

7. A construction unit as claimed in claim 6, wherein the side rails are tubular.

8. A construction unit as claimed in claim 6, wherein the side rails of a unit are open channels, in back to back relationship and adapted to accept therein the reenforcing members.

9. A construction unit as claimed in claim 7 or 8, wherein the unit is manufactured by a plastic blow molding process.

* * * * *